US010946229B2

(12) United States Patent
Tsai

(10) Patent No.: US 10,946,229 B2
(45) Date of Patent: Mar. 16, 2021

(54) EXERCISING EQUIPMENT COMBINATION

(71) Applicant: Yu-Lun Tsai, Taichung (TW)

(72) Inventor: Yu-Lun Tsai, Taichung (TW)

( * ) Notice: Subject to any disclaimer, the term of this patent is extended or adjusted under 35 U.S.C. 154(b) by 2 days.

(21) Appl. No.: 16/459,910

(22) Filed: Jul. 2, 2019

(65) Prior Publication Data

US 2020/0047017 A1 Feb. 13, 2020

(30) Foreign Application Priority Data

Aug. 13, 2018 (TW) ..... 107128156 A

(51) Int. Cl.

| | |
|---|---|
| ***A63B 17/04*** | (2006.01) |
| ***A63B 22/06*** | (2006.01) |
| ***A63B 22/00*** | (2006.01) |
| ***A63B 22/02*** | (2006.01) |

(52) U.S. Cl.

CPC ..... *A63B 17/04* (2013.01); *A63B 22/0056* (2013.01); *A63B 22/02* (2013.01); *A63B 22/0605* (2013.01); *A63B 2225/105* (2013.01); *A63B 2225/68* (2013.01)

(58) Field of Classification Search

CPC ..... A63B 17/00; A63B 17/02; A63B 17/04; A63B 22/0056; A63B 22/02; A63B 22/0605; A63B 22/0694; A63B 5/12; A63B 2102/16; A47B 87/00; A47B 87/002

USPC ..... 482/148, 57, 52, 908; 297/135, 172, 297/170–171, 156; 108/66, 64

See application file for complete search history.

(56) References Cited

U.S. PATENT DOCUMENTS

| | | | | | |
|---|---|---|---|---|---|
| 2,654,647 | A * | 10/1953 | Murray | A47B 3/083 | 108/173 |
| 3,267,881 | A * | 8/1966 | Saggione | A47C 1/11 | 108/59 |
| 3,964,401 | A * | 6/1976 | Gutmann, Jr. | A47B 83/001 | 108/64 |
| 5,016,405 | A * | 5/1991 | Lee | A47B 83/001 | 108/60 |
| 5,037,085 | A * | 8/1991 | Wexler | A63B 23/03575 | 482/148 |
| 5,088,419 | A * | 2/1992 | Hartwell | A47B 3/083 | 108/166 |
| 5,257,701 | A * | 11/1993 | Edelson | A47B 3/10 | 108/116 |
| 5,782,526 | A * | 7/1998 | Ott | A47B 83/02 | 297/157.1 |
| 5,799,587 | A * | 9/1998 | Branch | A47F 5/10 | 108/66 |

(Continued)

FOREIGN PATENT DOCUMENTS

TW M539361 U 4/2017

*Primary Examiner* — Loan B Jimenez
*Assistant Examiner* — Thao N Do
(74) *Attorney, Agent, or Firm* — Alan D. Kamrath; Karin L. Williams; Mayer & Williams PC

(57) ABSTRACT

An exercising equipment combination includes a plurality of exercising devices, and a connecting device connecting the exercising devices. Front ends of the exercising devices abut each other. Each of the exercising devices includes a support post and a secondary table mounted on the support post. The secondary tables of the exercising devices are juxtaposed and put together to form a primary table which has a predetermined geometric shape.

5 Claims, 8 Drawing Sheets

(56) References Cited

U.S. PATENT DOCUMENTS

| | | | | |
|---|---|---|---|---|
| 6,007,462 | A * | 12/1999 | Chen | A63B 22/001 482/51 |
| 10,070,718 | B2 * | 9/2018 | Tao | A47B 3/0803 |
| 2011/0001339 | A1 * | 1/2011 | Krueger | A47B 13/021 297/135 |
| 2014/0194257 | A1 * | 7/2014 | Ceysens | A63B 21/0054 482/63 |
| 2014/0360413 | A1 * | 12/2014 | Schenk | A47B 21/02 108/50.11 |
| 2015/0375029 | A1 * | 12/2015 | Yin | H02P 9/06 482/2 |
| 2016/0183680 | A1 * | 6/2016 | Stubbs | A47B 9/00 297/135 |
| 2018/0235359 | A1 * | 8/2018 | Reinhart | A47B 9/00 |
| 2019/0069668 | A1 * | 3/2019 | Cameron | A47B 87/002 |

* cited by examiner

EXERCISING EQUIPMENT COMBINATION

BACKGROUND OF THE INVENTION

1. Field of the Invention

The present invention relates to a sports arrangement and, more particularly, to an exercising equipment combination.

2. Description of the Related Art

In the gym, multiple exercising devices are located in place to be operated by the users. However, the exercising devices are operated individually and do not provide an interaction therebetween such that the users cannot face and communicate with each other, thereby decreasing the amusement during exercising. A conventional exercising device was disclosed in the Taiwanese Utility Patent No. M539361, and comprises a table, a frame, a joint device, a driving device, and a seat device. The joint device is mounted between the table and the frame. The joint device includes a bottom bracket, an upright post, a transverse rod, a first connecting member and a second connecting member. The bottom bracket is placed on the ground and connected with the frame. The upright post is mounted on the bottom bracket. The transverse rod is connected with the upright post. The first connecting member has a first end mounted on the transverse rod, and a second end combined with the table. The second connecting member is located under the first connecting member, and is connected with the bottom bracket. The driving device includes a pedal unit and a rotary wheel. The pedal unit is arranged on two sides of the upright post. The rotary wheel is mounted on the bottom bracket. The seat device is mounted on the frame. Thus, the user may work, or dine during exercising. However, the tables of two exercising devices cannot be combined such that the two users on two exercising devices cannot face and communicate with each other, thereby decreasing the amusement during exercising.

BRIEF SUMMARY OF THE INVENTION

In accordance with the present invention, there is provided an exercising equipment combination comprising a plurality of exercising devices, and a connecting device connecting the exercising devices. Front ends of the exercising devices abut each other. Each of the exercising devices includes a support post and a secondary table mounted on the support post. The secondary tables of the exercising devices are juxtaposed and put together to form a primary table. The primary table has a predetermined geometric shape.

Preferably, the exercising devices have different functions and different structures.

Preferably, the exercising devices have the same function and the same structure.

Preferably, the connecting device includes a plurality of first connecting members and a plurality of second connecting members.

Preferably, the first connecting members of the connecting device are mounted on the support posts of the exercising devices, to connect and combine the support posts of the exercising devices together.

Preferably, the second connecting members of the connecting device are mounted on adjacent two of the secondary tables of the exercising devices, to connect and combine the secondary tables of the exercising devices together.

Preferably, the first connecting members of the connecting device are connected together and encircle the support posts of the exercising devices.

Preferably, the support posts of the exercising devices surround a center piece, each of the first connecting members of the connecting device is mounted on the support post of one of the exercising devices, and is inserted into and secured to the center piece.

According to the primary advantage of the present invention, the exercising devices are juxtaposed and combined together, to build a sports group, to provide an interaction, and to construct the primary table with a larger area, such that the users directly face and communicate with each other during the exercising process, thereby enhancing the amusement of sports.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
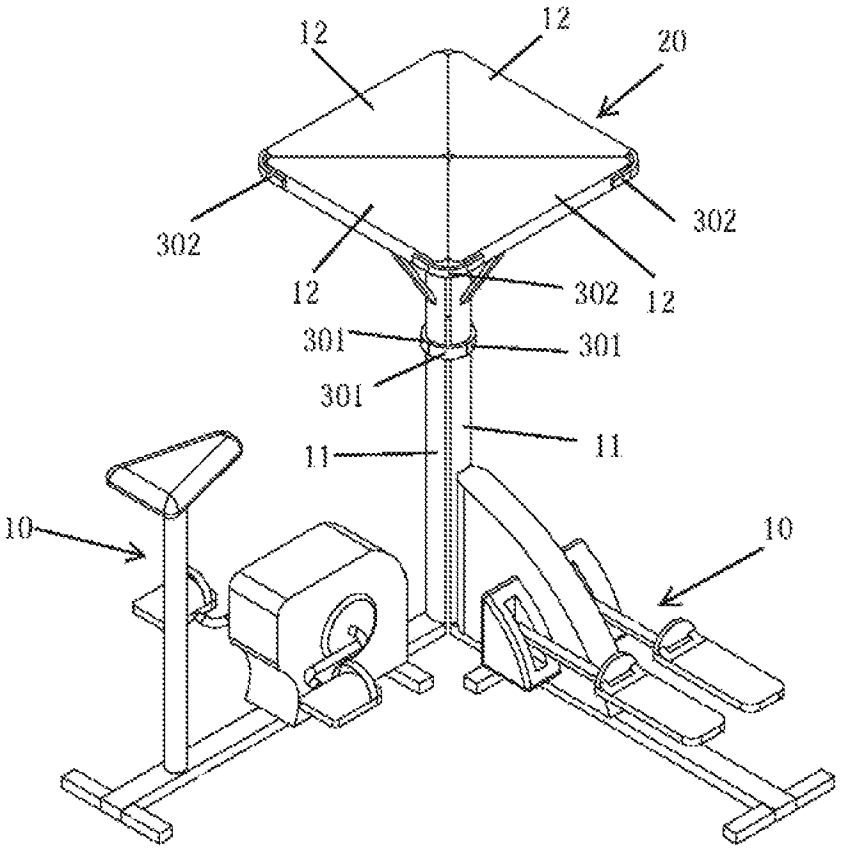
FIG. 1 is a perspective view of an exercising equipment combination in accordance with the first preferred embodiment of the present invention.
Figure 2:
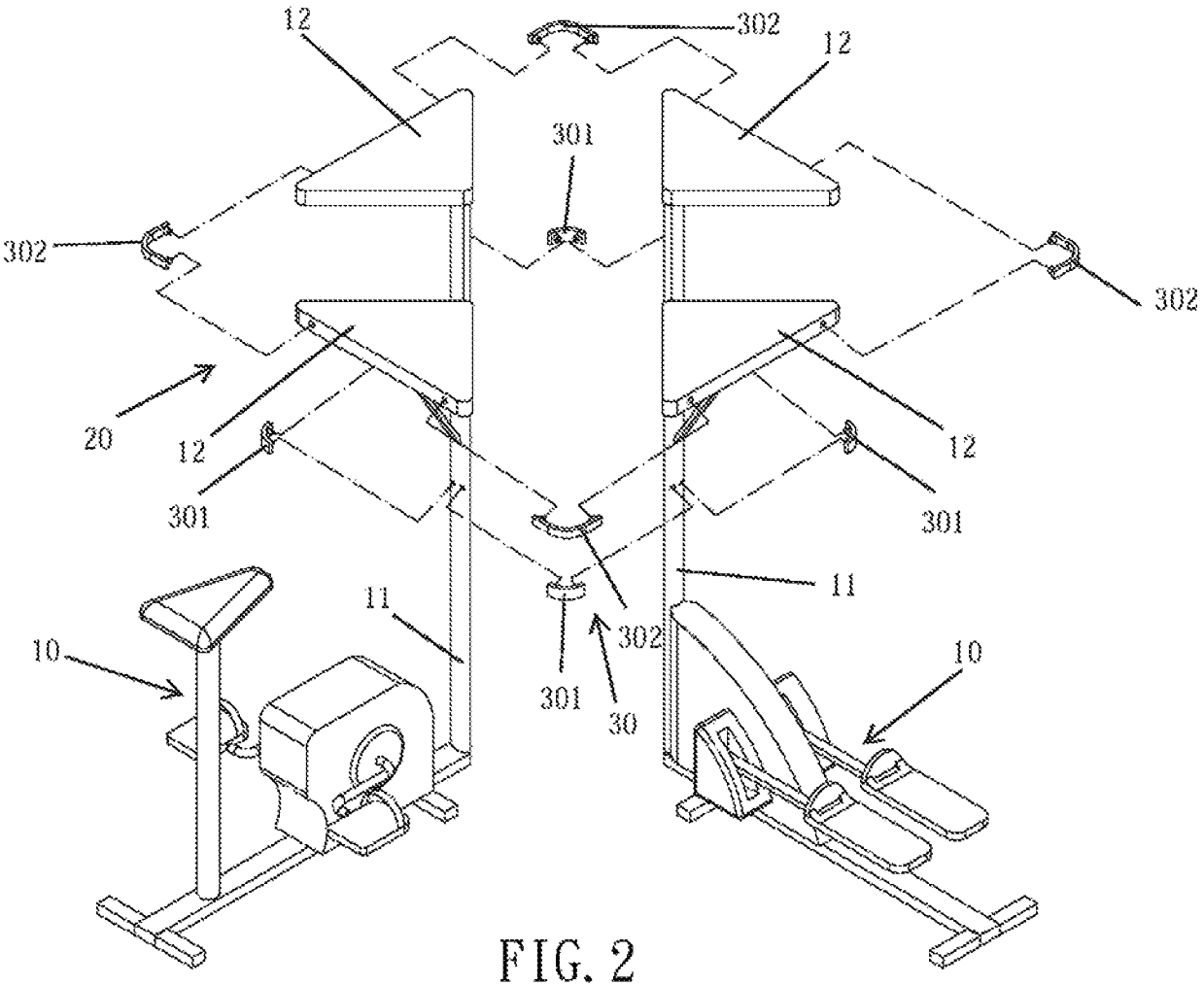
FIG. 2 is an exploded perspective view of the exercising equipment combination as shown in FIG. 1.

Referring to the drawings and initially to FIGS. 1-5, an exercising equipment combination in accordance with the preferred embodiment of the present invention comprises a plurality of exercising devices 10, and a connecting device 30 connecting the exercising devices 10. Preferably, front ends of the exercising devices 10 abut (or adjoin) each other or are juxtaposed to each other. Each of the exercising devices 10 includes an upright support post 11 and a secondary table 12 mounted on the support post 11. The secondary tables 12 of the exercising devices 10 are juxtaposed and put together to form a primary table 20. The primary table 20 has a predetermined geometric shape. Preferably, the primary table 20 has a square shape (see FIG. 1), a rectangular shape or a hexagonal shape (see FIG. 5).

In the preferred embodiment of the present invention, the exercising devices 10 have different functions and different structures. Alternatively, the exercising devices 10 have the same function and the same structure.

In the preferred embodiment of the present invention, the connecting device 30 includes a plurality of first connecting members 301 and a plurality of second connecting members 302.

In the preferred embodiment of the present invention, the first connecting members 301 of the connecting device 30 are mounted on the support posts 11 of the exercising devices 10, to connect and combine the support posts 11 of the exercising devices 10 together.

In the preferred embodiment of the present invention, the second connecting members 302 of the connecting device 30 are mounted on adjacent two of the secondary tables 12 of the exercising devices 10, to connect and combine the secondary tables 12 of the exercising devices 10 together.

Figure 3:
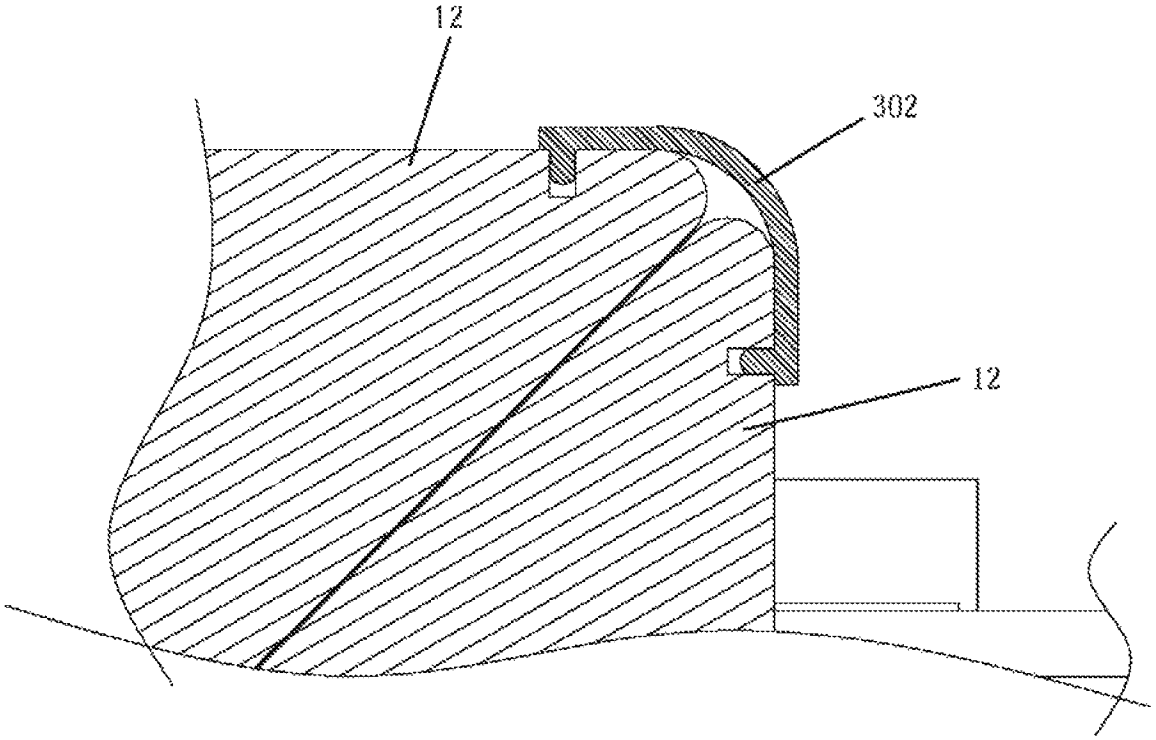
FIG. 3 is a partial cross-sectional view showing a second connecting member connecting two secondary tables.
Figure 4:
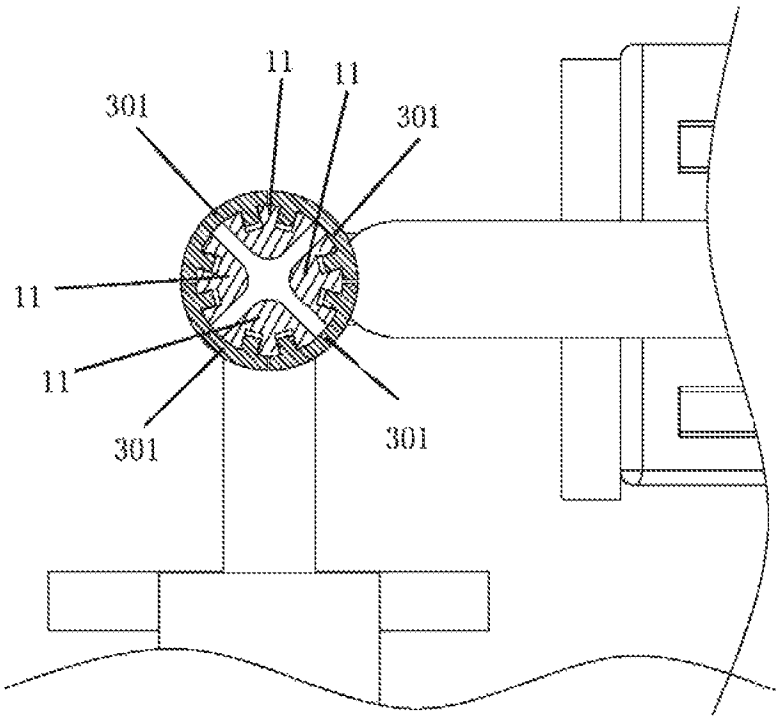
FIG. 4 is a partial cross-sectional view showing the first connecting members connecting the support posts.
Figure 5:
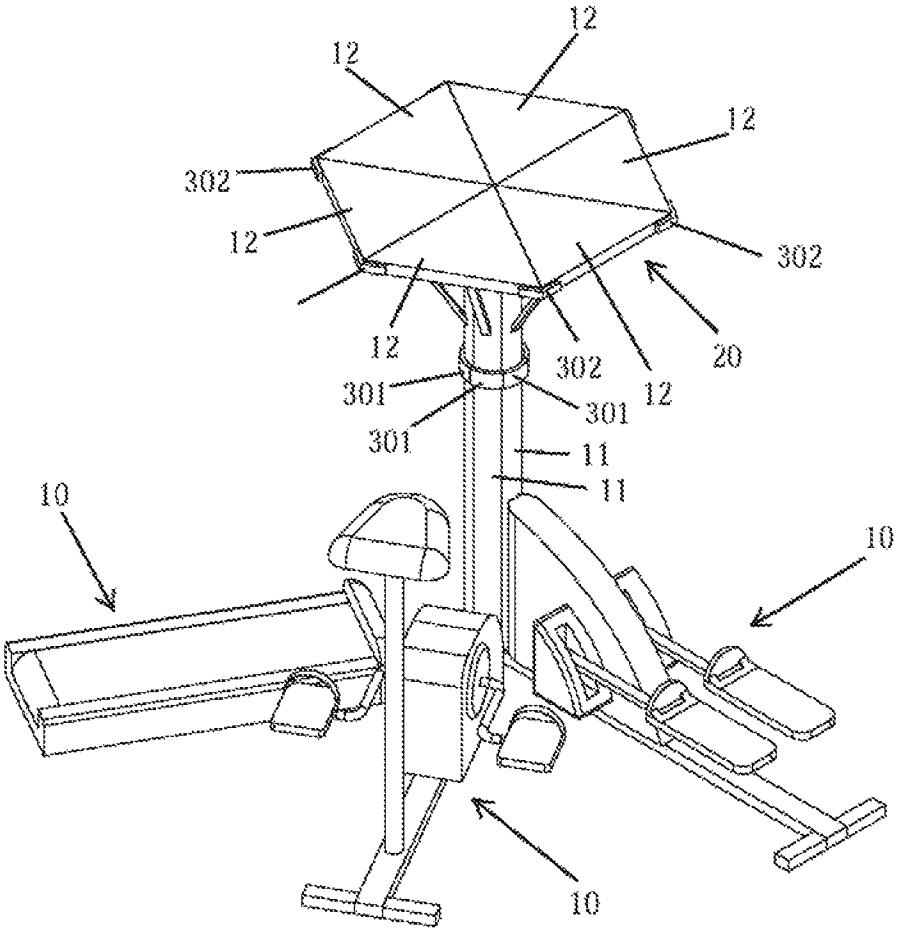
FIG. 5 is a perspective view showing the exercising equipment combination including six exercising devices in accordance with the first preferred embodiment of the present invention.

In the preferred embodiment of the present invention, the first connecting members 301 of the connecting device 30 are connected together to encircle the support posts 11 of the exercising devices 10 as shown in FIG. 4. Each of the second connecting members 302 of the connecting device 30 connects the adjacent two of the secondary tables 12 of the exercising devices 10 as shown in FIG. 3.

Figure 6:
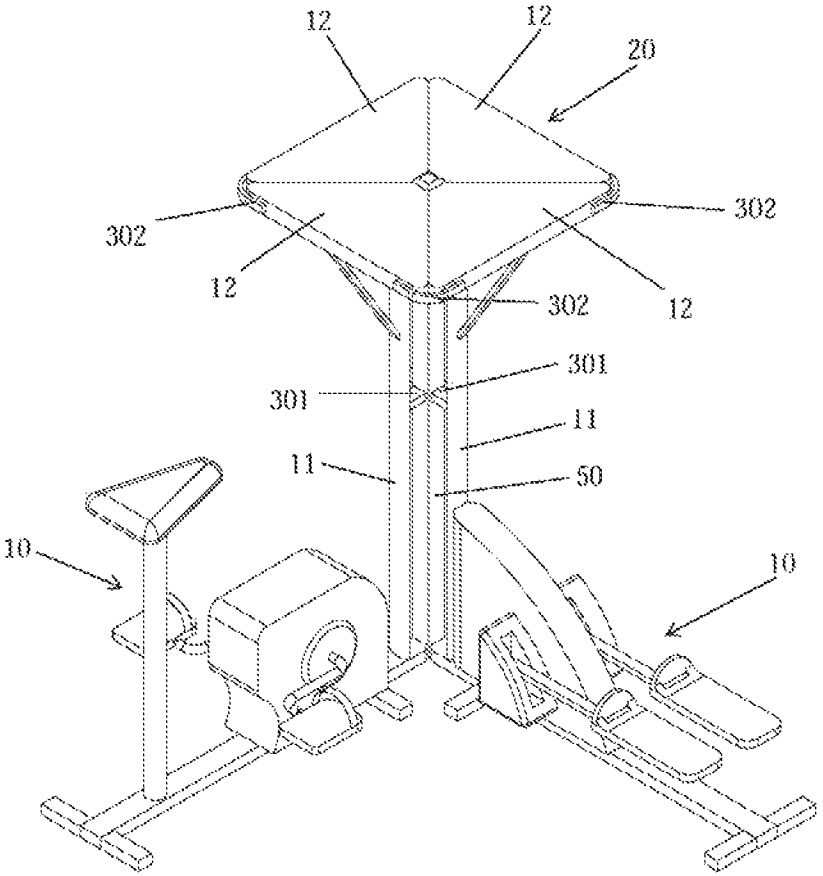
FIG. 6 is a perspective view of an exercising equipment combination in accordance with the second preferred embodiment of the present invention.
Figure 7:
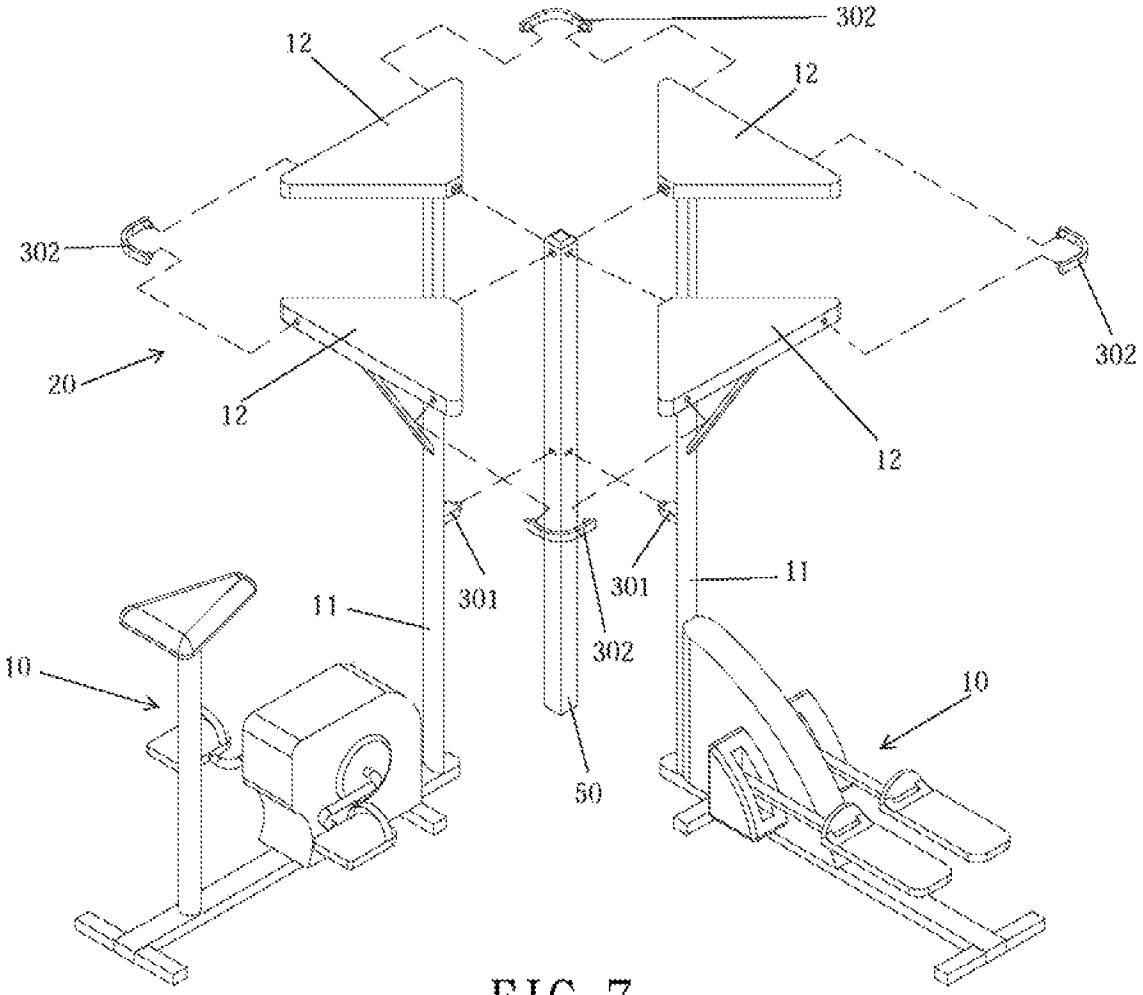
FIG. 7 is an exploded perspective view of the exercising equipment combination as shown in FIG. 6.
Figure 8:
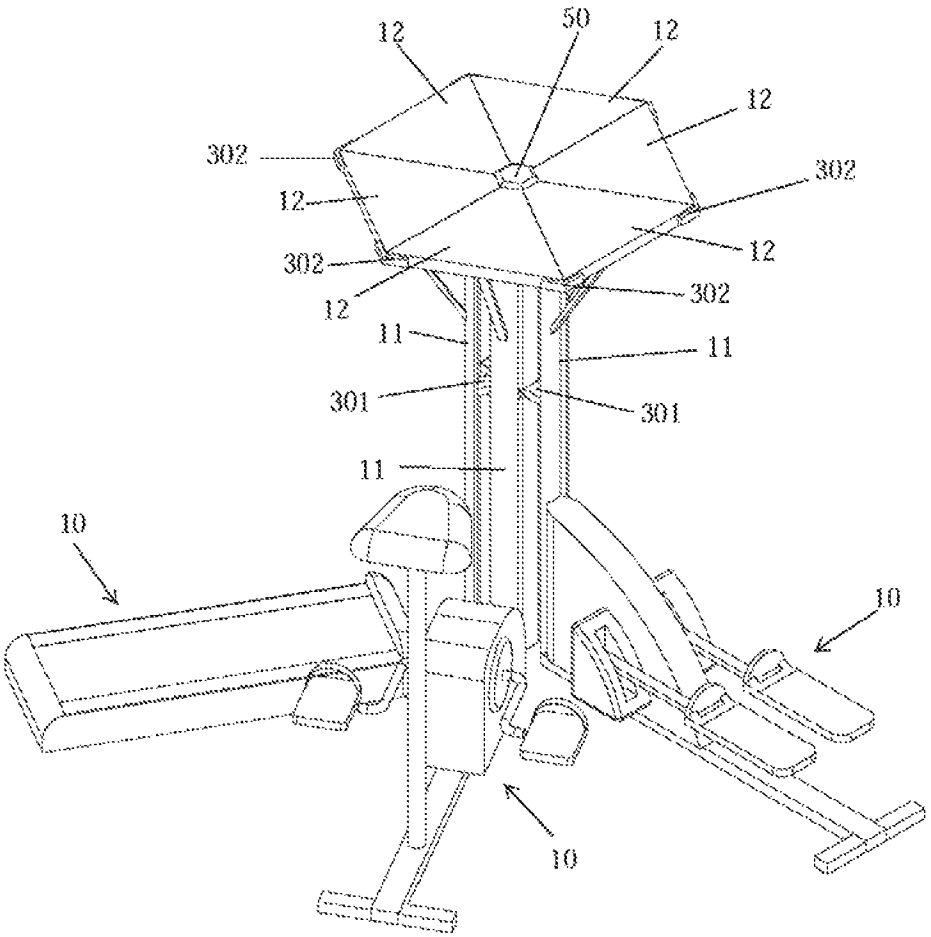
FIG. 8 is a perspective view showing the exercising equipment combination including six exercising devices in accordance with the second preferred embodiment of the present invention.

Referring to FIGS. 6-8, the support posts 11 of the exercising devices 10 surround a center piece (or fixture) 50, each of the first connecting members 301 of the connecting device 30 is mounted on the support post 11 of one of the exercising devices 10, and is inserted into and secured to the center piece 50, such that the support posts 11 of the exercising devices 10 are fixed by the center piece 50.

Accordingly, the exercising equipment combination comprises multiple exercising devices 10 that are connected by the connecting device 30, such that the exercising devices 10 are combined to construct a composite exercising system. In addition, the exercising devices 10 are assembled and disassembled easily and quickly. Further, the exercising devices 10 are juxtaposed and combined together, to build a sports group, to provide an interaction, and to construct the primary table 20 with a larger area, such that the users directly face and communicate with each other during the exercising process, thereby enhancing the amusement of sports.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An exercising equipment combination comprising:

a plurality of exercising devices; and a connecting device connecting the plurality of exercising devices;

wherein:

front ends of the plurality of exercising devices abut each other;

each of the plurality of exercising devices includes a support post and a secondary table mounted on the support post;

the secondary tables of the plurality of exercising devices are juxtaposed and put together to form a primary table;

the primary table has a predetermined geometric shape;

the connecting device includes a plurality of first connecting members and a plurality of second connecting members;

the plurality of first connecting members of the connecting device are mounted on the support posts of the plurality of exercising devices, to connect and combine the support posts of the plurality of exercising devices together;

the plurality of first connecting members of the connecting device are connected together and encircle the support posts of the plurality of exercising devices.

2. The exercising equipment combination of claim 1, wherein the plurality of exercising devices have different functions and different structures.

3. The exercising equipment combination of claim 1, wherein the plurality of exercising devices have the same function and the same structure.

4. The exercising equipment combination of claim 1, wherein the plurality of second connecting members of the connecting device are mounted on adjacent two of the secondary tables of the plurality of exercising devices, to connect and combine the secondary tables of the plurality of exercising devices together.

5. An exercising equipment combination comprising:

a plurality of exercising devices; and a connecting device connecting the plurality of exercising devices;

wherein:

front ends of the plurality of exercising devices abut each other;

each of the plurality of exercising devices includes a support post and a secondary table mounted on the support post;

the secondary tables of the plurality of exercising devices are juxtaposed and put together to form a primary table;

the primary table has a predetermined geometric shape;

the connecting device includes a plurality of first connecting members and a plurality of second connecting members; and the support posts of the plurality of exercising devices surround a center piece, each of the plurality of first connecting members of the connecting device is mounted on the support post of one of the plurality of exercising devices, and is inserted into and secured to the center piece.

* * * * *